US008186571B2

(12) United States Patent
Field et al.

(10) Patent No.: US 8,186,571 B2
(45) Date of Patent: May 29, 2012

(54) CUP SLING

(76) Inventors: Elizabeth Dean Field, Brattleboro, VT (US); Benjamin Gallant, Berkeley, CA (US); Eric Chavez, San Francisco, CA (US)

( * ) Notice: Subject to any disclaimer, the term of this patent is extended or adjusted under 35 U.S.C. 154(b) by 345 days.

(21) Appl. No.: 12/535,656

(22) Filed: Aug. 4, 2009

(65) Prior Publication Data

US 2010/0032457 A1 Feb. 11, 2010

Related U.S. Application Data

(60) Provisional application No. 61/087,533, filed on Aug. 8, 2008.

(51) Int. Cl.
*B65D 3/28* (2006.01)

(52) U.S. Cl. ..... 229/402; 229/117.19; 229/117.22; 229/117.23

(58) Field of Classification Search ..... 229/117.19, 229/117.22, 117.23, 402; 220/737, 738, 220/741, 758, 759; 294/31.2, 33, 167, 169, 294/170

See application file for complete search history.

(56) References Cited

U.S. PATENT DOCUMENTS

| | | | | |
|---|---|---|---|---|
| 2,194,898 | A * | 3/1940 | Hanford | 294/31.2 |
| 3,620,410 | A * | 11/1971 | Griese, Jr. | 220/758 |
| 4,763,833 | A * | 8/1988 | Stoll | 229/117.23 |
| 4,799,723 | A * | 1/1989 | Mahaffy | 294/87.2 |
| 5,417,365 | A * | 5/1995 | Lindsay | 229/117.22 |
| 5,484,100 | A * | 1/1996 | Rigby | 229/101.1 |
| 6,116,503 | A * | 9/2000 | Varano | 229/402 |
| 2002/0148888 | A1 * | 10/2002 | Kim | 229/402 |
| 2009/0126149 | A1 * | 5/2009 | Whittaker | 16/111.1 |

* cited by examiner

*Primary Examiner* — Gary Elkins

(57) ABSTRACT

A cup sling is a carrier for a frusto-conical container that is a sleeve with straps for retaining and carrying the container. The sleeve defines an opening to receive the cup. The sleeve is cut in such a manner so that, when the top portion and the bottom portion of the sleeve are twisted in opposite directions, the center portion will form two loops, or straps, that will extend out to the sides of the container. These straps can be retained above the container to hold the container in a generally vertical position allowing the user to hang the container from a finger or hook. In addition, the user can tote the container in the cup sling while using the hand concurrently to hold or tote other items.

2 Claims, 4 Drawing Sheets

CUP SLING

FIELD OF THE INVENTION

The field relates to handles for carrying frusto-conical containers; especially hot beverage containers.

BACKGROUND OF THE INVENTION

It has been determined that carrying a coffee cup in the manner of carrying a pail is a much safer and more convenient way of carrying a coffee cup or any frusto-conical container.

An extremely cost effective way to manufacture the straps, or handles, is to cut an existing "cup sleeve" in such a way as to provide strap handles that can extend above the top of the cup.

BRIEF DESCRIPTION OF THE DRAWINGS

The objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

Note to Figures: the dimensions are not included in figures as this carrier design can be adapted to almost any size container.

DESCRIPTION AND MANUFACTURING GUIDELINES

The cup sling is a carrier for a frusto-conical container constructed from a paperboard material. The paperboard should be coated with a substance to render it water-resistant. The industrial application of polyethylene coatings is readily available to known artisans.

Figure 1:
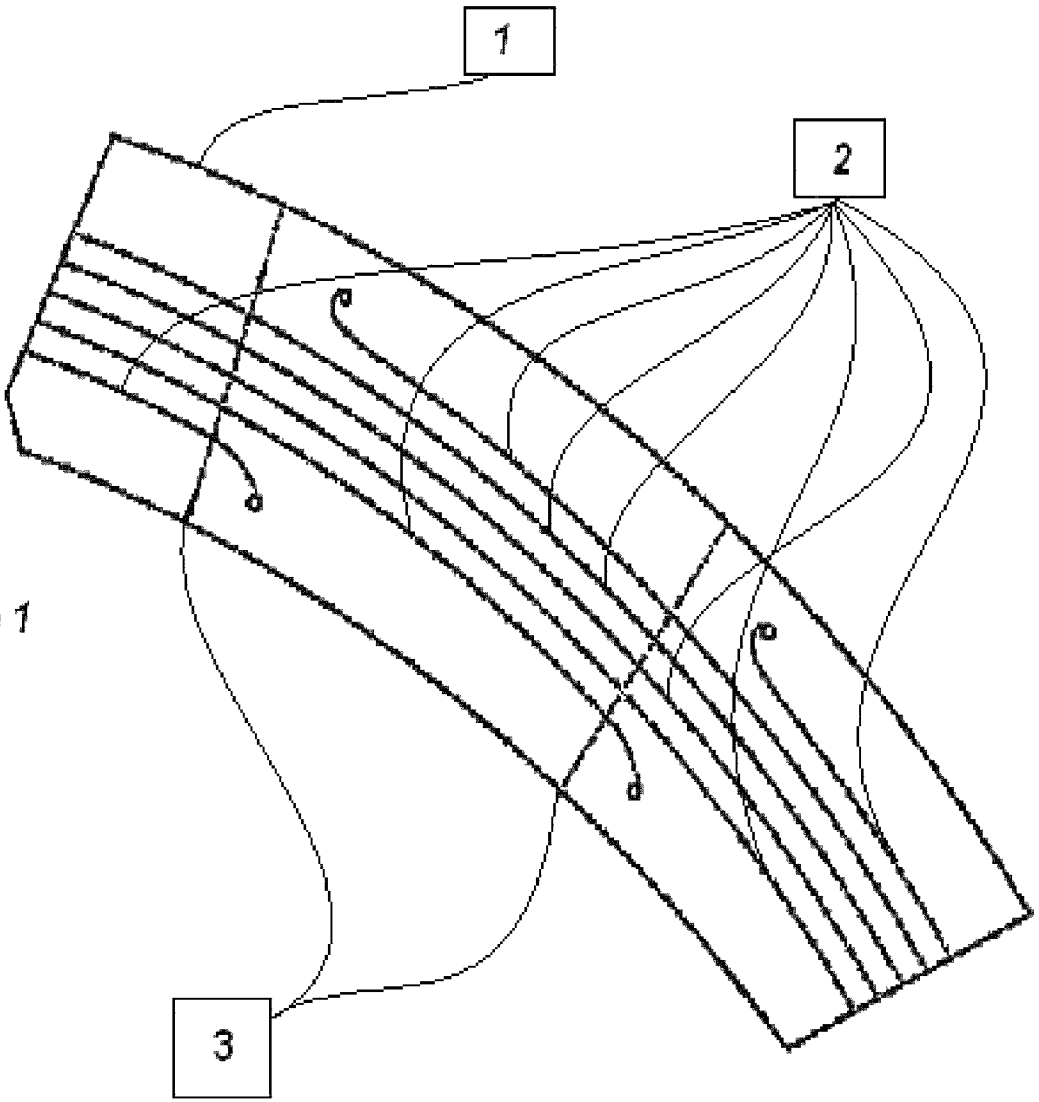
FIG. 1 is a view of the die cut pattern required to manufacture the cup carrier.
Figure 3:
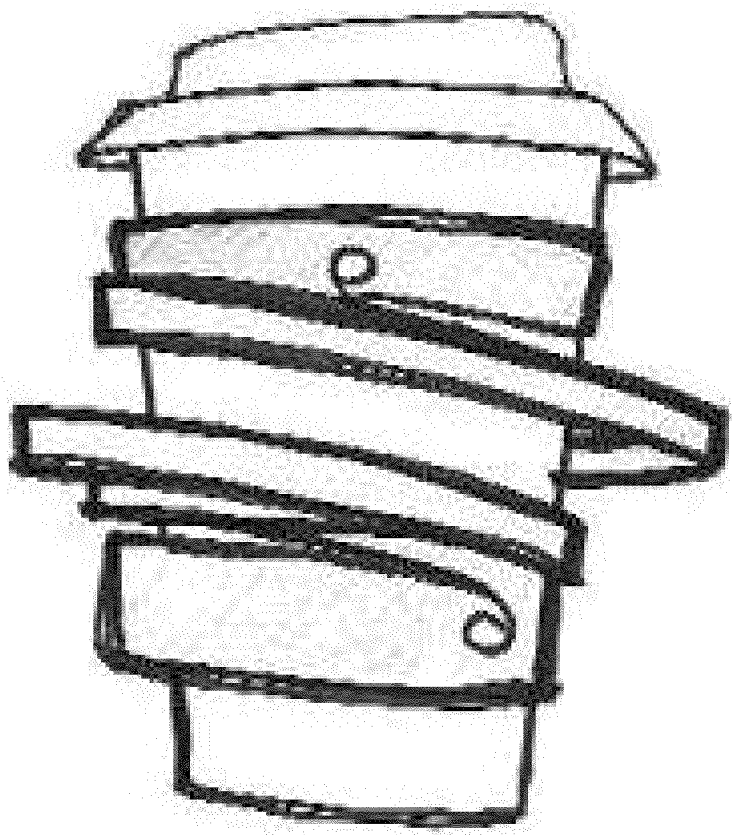
FIG. 3 is an illustration of the carrying straps sticking out slightly after the top and the bottom of the cup carrier have been gently twisted in opposite directions.
Figure 2:
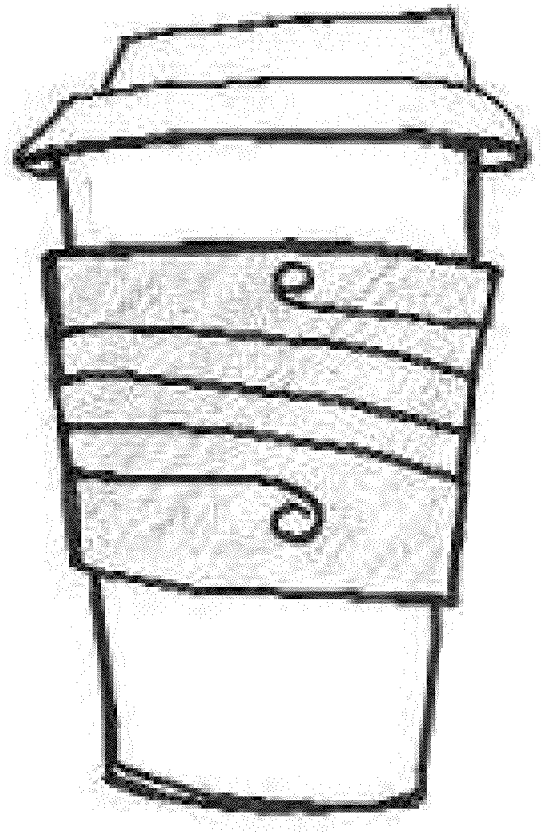
FIG. 2 is an illustration of the cup carrier used as a "cup sleeve"
Figure 4:
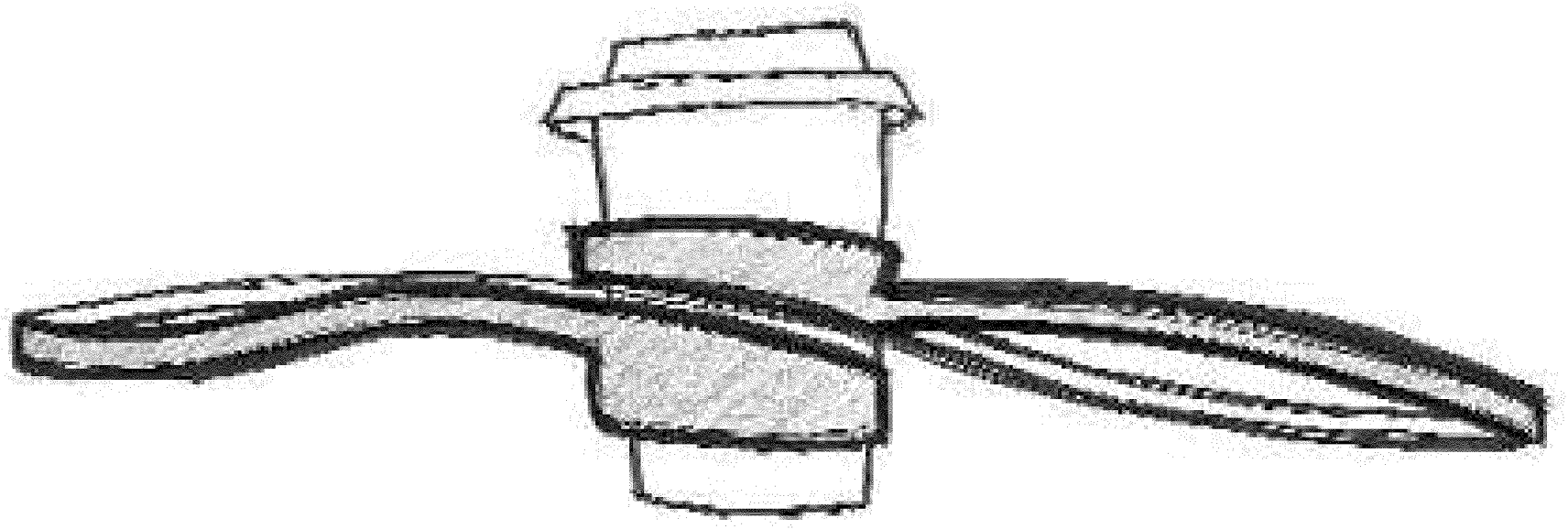
FIG. 4 is an illustration of the carrying straps sticking out to the sides after the user has pulled them out to their full length.
Figure 5:
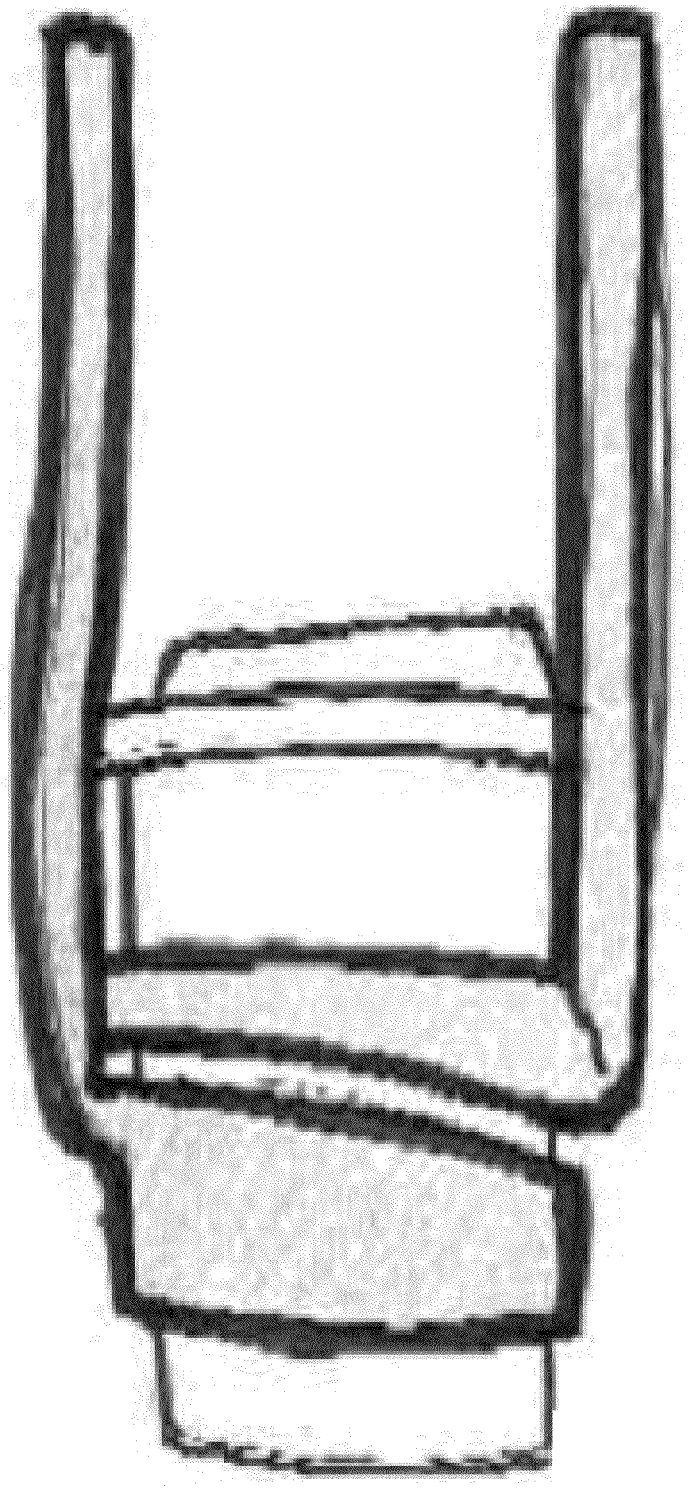
FIG. 5 is an illustration of the carrying straps in a position suitable for carrying.

The coated paperboard is cut into an arcuate shape, such as that depicted in FIG. 1, with a width to height ratio of approximately 1:5. The arcuate shape, which is preferably concave at the top and convex at the bottom, permits the holder to be folded and glued so as to be opened into a generally conical configuration, allowing a frusto-conical container to be introduced into the top opening as shown in FIG. 2.

The coated paperboard is further cut so that straps can be separated from the body of the carrier and used as handles to tote the frusto-conical container as shown in FIGS. 2 to 5.

DESCRIPTION OF THE CUTS

Referring to FIG. 1, an illustration of the form of the cup carrier showing the solid outline (1); 7 perforated interior lines (2); and 3 fold lines (3).

Seven arcuate cuts are made in the carrier in such a way as to be generally parallel to the edge of the carrier.

The cuts are evenly spaced over three fifths of the width of the carrier.

The first cut should be made approximately one fifth of the width from the top of the carrier and the seventh cut should be made approximately a fifth of the width of the carrier from the bottom edge of the carrier.

The three center cuts, with the exception of interruptions described below, span the entire length of the unassembled carrier.

The upper two cuts and the lower two cuts only partially span the unassembled carrier.

The upper two cuts begin from the right edge of the unassembled carrier.

The lower two cuts begin from the left edge of the unassembled carrier.

All four of these cuts end in small arcs, arcing away from the middle three cuts.

The top and bottom cuts each span approximately a third of the length of the unassembled carrier.

The second cut from the top and the sixth cut from the top span approximately two thirds of the length of the unassembled carrier.

The paperboard should be creased along "fold lines", that is lines that run perpendicular to the above described arcuate cuts, the cuts being interrupted for at least two tenths of an inch at these fold lines and also at the boarders of the carrier. These interruptions in the cuts will provide a means for the carrier to remain intact during assembly, packaging and dispensing.

ASSEMBLY OF THE CARRIER

Once the above cuts have been made in the coated paperboard, an adhesive will be applied to one edge of the carrier. The carrier shall then be folded along the above described "fold lines" in such a manner that the two ends of the carrier shall overlap. The bond formed by the overlapping ends of the carrier and the adhesive shall have a tensile strength at least equal to that of the coated paperboard.

DESCRIPTION OF THE USE OF THE CARRIER: SEE FIGS. 2-5

The cup sling is designed to be slid onto a frusto-conical container carrying material. Once the cup sling is in place, the user should grasp the top fifth of the cup sling with one hand and the bottom fifth of the cup sling with the other hand and using a twisting motion move the top and the bottom of the cup sling in opposite directions. This motion will cause the cut straps to be extended out to the sides of the container. With the straps fully extended, the user should collect the two straps together above the container and suspend the container from a finger or hook.

What is claimed is:

1. A carrier for receiving a frusto-conical container, the carrier comprising:

a sleeve defining an opening to receive the container, the sleeve having cuts extending at least partially around the sleeve that form straps between a top portion and a bottom portion of the sleeve, the cuts being made in such a way that the straps can be extended from the sleeve by twisting the top and bottom portions of the sleeve around the container in opposite directions with respect to each other, and the straps can be retracted into the sleeve by twisting the top and bottom portions of the sleeve around the container in opposite directions with respect to each other, the cuts including perforations to allow the sleeve to retain its integrity during manufacturing, packing and dispensing.

2. A carrier of claim 1 wherein the sleeve is made of paperboard with a water-resistant coating applied.

* * * * *